US005232110A

United States Patent [19]

Purnell

[11] Patent Number: 5,232,110

[45] Date of Patent: Aug. 3, 1993

[54] CONTAINER CLOSURE

[76] Inventor: Peter F. Purnell, 2206 Arbor Vitae La., Spring Valley, Calif. 91977

[21] Appl. No.: 803,123

[22] Filed: Dec. 4, 1991

[51] Int. Cl.[5] ..... B65D 51/16; B67D 3/00

[52] U.S. Cl. ..... 215/312; 215/309; 215/311; 222/481; 222/481.5

[58] Field of Search ..... 215/231, 261, 309, 311, 215/312; 222/481, 481.5, 482, 464, 568; 220/714

[56] References Cited

U.S. PATENT DOCUMENTS

| | | | |
|---|---|---|---|
| 880,669 | 3/1908 | Keller | 222/481.5 |
| 1,278,764 | 9/1918 | Seiler . | |
| 1,773,475 | 2/1928 | Casey . | |
| 2,081,823 | 5/1937 | Kunz | 215/309 X |
| 2,167,220 | 1/1965 | Koubal . | |
| 2,642,207 | 6/1953 | Renzi | 215/309 X |
| 2,991,897 | 7/1959 | Burnett . | |
| 3,104,786 | 9/1963 | Sanchis | 222/481 |
| 3,135,411 | 6/1964 | Osborne . | |
| 3,506,167 | 4/1970 | Orr | 215/309 X |
| 3,878,962 | 4/1975 | Holbrook et al. | 215/309 |
| 4,033,091 | 7/1977 | Saponara | 215/228 X |
| 4,059,113 | 11/1977 | Beinsen et al. . | |
| 4,134,697 | 1/1979 | Sparr, Sr. | 222/481.5 X |
| 4,328,909 | 5/1982 | Jeans | 222/481.5 X |
| 4,407,435 | 10/1983 | Harmon . | |
| 4,583,668 | 4/1986 | Maynard, Jr. | 222/546 X |
| 4,629,098 | 12/1986 | Eger | 220/903 X |
| 4,736,082 | 4/1988 | Saville . | |
| 4,821,895 | 4/1989 | Roskilly | 215/228 X |
| 4,838,464 | 6/1989 | Briggs | 222/481 X |
| 4,967,922 | 11/1990 | Alder | 215/309 |

*Primary Examiner*—Allan N. Shoap
*Assistant Examiner*—Vanessa Caretto
*Attorney, Agent, or Firm*—J. F. McLellan

[57] ABSTRACT

A container closure for attachment to a threaded container neck and comprising a closure top having a pouring passage and an offcenter opening which receives a tube defining an air passage, the tube being adapted to extend to a position adjacent to the container bottom offset from its centerline, the tube including a check valve to admit air to the container while excluding liquid from the tube. The arrangement enables the pouring of a regular and steady stream of liquid from the container.

7 Claims, 1 Drawing Sheet

FIG. 1
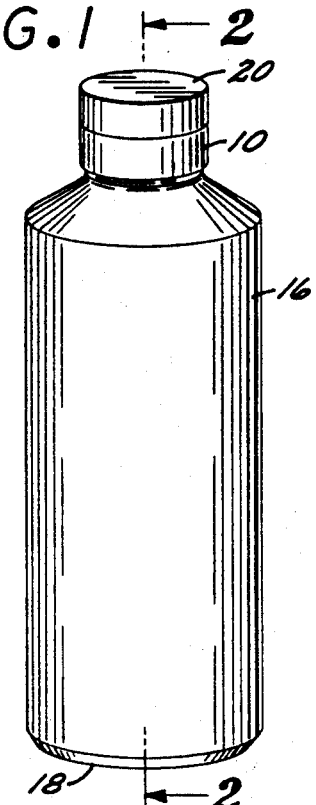
FIG. 2
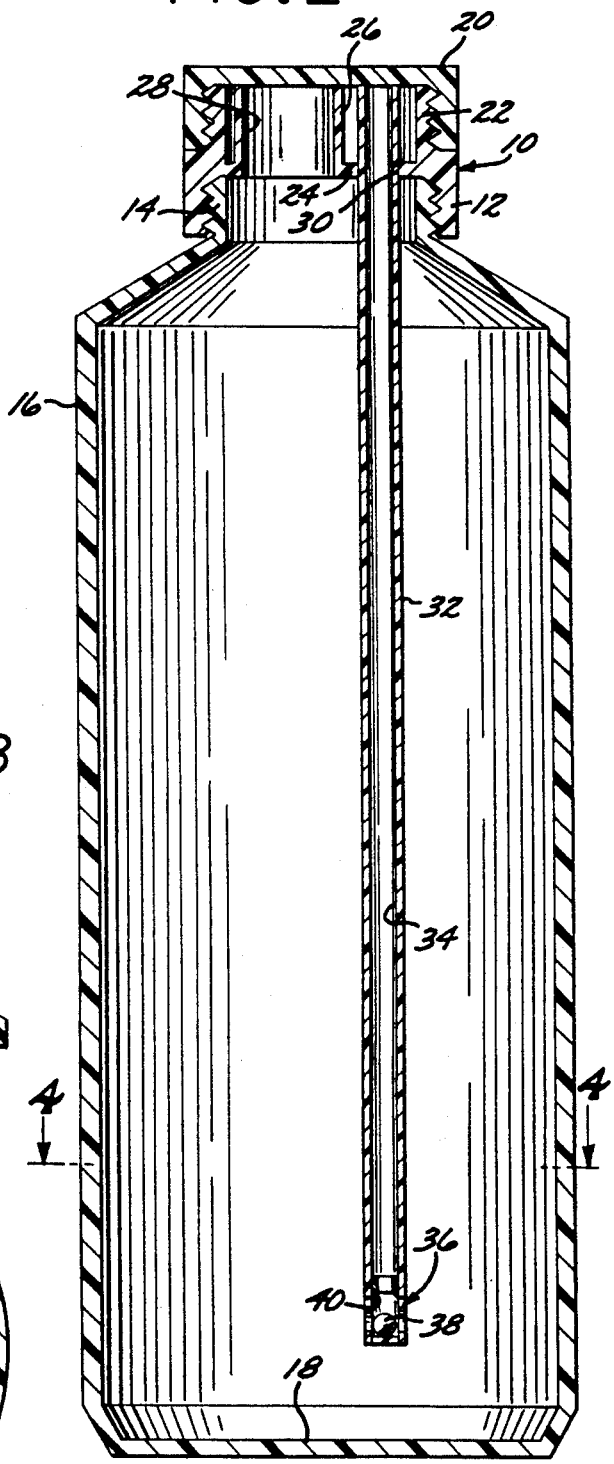
FIG. 3
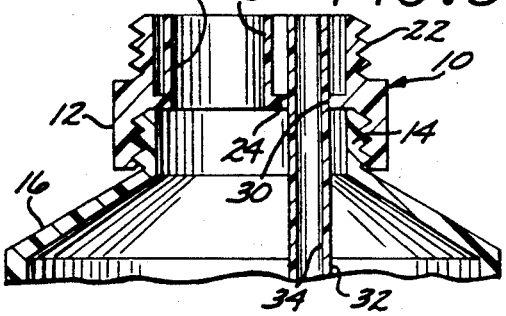
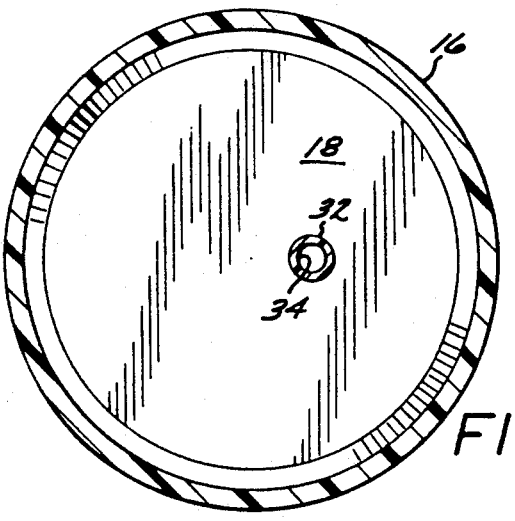
FIG. 4

CONTAINER CLOSURE

BACKGROUND OF THE INVENTION

1. Field of the Invention

The present invention relates to a container closure which admits air to promote a regular and steady flow of liquid from the container.

2. Description of the Prior Art

As liquid is poured from a container, a temporary low pressure area or void develops. The stream of liquid momentarily ceases to flow until air enters the container through the pouring spout to compensate for the low pressure. When this occurs liquid flow resumes. The alternate passage of liquid and air through the same spout causes the flow of liquid to be uneven and irregular, sometimes to such an extent that liquid splashes where it is not wanted.

Container closures exist in the prior art which admit air through an air passage which is separate from the liquid passage or pouring spout. Such closures often include a one-way or check valve in the air passage to prevent liquid entry. U.S. Pat. Nos. 1,278,764 (Seiler); 1,773,475 (Casey); 2,991,897 (Burnett); and 4,407,435 (Harmon) are pertinent in this regard. Despite the presence of the check valve, until the contents of the container are substantially emptied, a somewhat irregular flow of liquid still occurs because the incoming air passes through liquid which seeks escape through the air passage.

Other container closures have been developed which permit air to enter at a point lower or deeper in the container. Consequently, when the container is tipped up the incoming air does not take a liquid path unless the container is absolutely full. A closure of this type is disclosed in U.S. Pat. No. 3,167,220 (Koukal).

The Koukal closure comprises a cork stopper having a dispensing passage, an air passage, and a pipe extension fitted to the stopper in communication with the air passage. An opening is provided in the pipe extension just below the cork stopper to enable air to enter at a point above the liquid level when the container is in an upright position. When the container is tipped up, the opening is located within the liquid. Consequently, incoming air must pass through the liquid and, conversely, since there is no check valve in the pipe extension, liquid can enter through the opening or for that matter also through the lower end of extension, thereby slowing or competing the flow of incoming air.

The Koukal pipe extension is also centrally located. At certain angles of tip of the container, unless it is partially empty, air coming out of the lower end of the extension also must pass through the liquid. As previously indicated, when incoming air and outgoing liquid compete for the same passageway there is a tendency for the flow of liquid to be irregular.

In view of the foregoing, there is a need for a container closure having an elongated tube to provide a passage for air to flow directly into the emptied area at the bottom of an upended container and, in those instances where the container is relatively full or is upright, includes a check valve in the lower end of the liquid from flowing into the tube.

SUMMARY OF THE INVENTION

The present container closure comprises a top which is adapted to thread onto the threaded neck of a container in place of the usual container top, and which is also adapted to threadably accept the container top to protect the contents of the container from atmosphere. The closure top includes a pouring passage and a separate opening to receive an elongated tube. The tube defines an air passage to admit air to compensate for displaced liquid and thereby promote a steady and regular flow of liquid from the container.

The tube is unapertured and is offset in relation to the center of the container top. It extends downwardly for admitting air at a point just above and off center from the bottom of the container. A check valve is provided in the lower end of the tube to prevent liquid entry. The arrangement promotes a regular and steady flow of the liquid being dispensed.

Other objects and features of the present invention will become apparent from the following more detailed description taken in conjunction with the accompanying drawings.

BRIEF DESCRIPTION OF THE DRAWINGS

FIG. 1 is a perspective view of the container closure of the present invention fitted onto the threaded neck of a container;

FIG. 2 is an enlarged view taken along the line 2—2 of FIG. 1;

FIG. 3 is an enlarged longitudinal cross sectional view of the closure and the container neck, with the container cap removed; and FIG. 4 is a view taken along the line 4—4 of FIG. 2.

DESCRIPTION OF THE PREFERRED EMBODIMENTS

Referring now to FIGS. 1–4, the container closure illustrated comprises, generally, a circular closure top 10 which has a cylindrical skirt or lower portion 12. The portion 12 is internally threaded for attachment to the usual externally threaded neck 14 of a cylindrical container 16 closed at is base by a bottom 18.

The closure top 10 can be threaded onto the neck 14 as a replacement for the usual internally threaded container cap or top 20, as seen in FIG. 3. This permits the contents to be poured from the container. After use, the container top 20 can be threaded onto external threads on the upper portion 22 of the closure top 10, as seen in FIG. 4, to seal the contents from atmosphere. Preferably the external diameter of the closure top 10 is the same as the external diameter of the container top 20 to provide a more aesthetically pleasing appearance, as seen in FIG. 1.

The closure top 10 includes a transverse wall 24 having an integral, upwardly extending cylindrical boss 26 which defines a pouring passage 28 for emptying the container 16.

The transverse wall 24 also includes a separate vertical opening 30 which is offset from the centerline of the closure top 10 for a reason which will become apparent.

A means is provided to admit air to the interior of the container 16 as its contents are emptied, the means comprising an elongated tube 32 having an upper extremity which is either integrally molded as a part of the top 10, or adhesively or otherwise secured within the opening 30 in the top 10.

The interior of the tube 32 defines an air passage 4 for admitting air from the atmosphere to the container interior. Air cannot otherwise escape because the tube 32 is unapertured, being open only at its upper and lower ends.

By reason of the offset location of the opening 30, the lower end of the tube 32 is similarly offset and, as seen in FIG. 4, is thereby located adjacent the container bottom 18 in offset relation to the centerline of the bottom.

The lower extremity of the tube 32 is provided with a one-way or check valve 36 comprising a slotted portion or cage formed in the end of the tube 32 and holding a valve or ball 38. The ball 38 is adapted to move against a valve seat 40 in the tube 32.

As will be apparent, air from the air passage 34 can move the ball 38 off its seat 40, and flow outwardly through the cage formed in the walls of the tube 32 to the container interior. Liquid flowing inwardly through the slotted cage will move the ball 38 onto its seat 40 and prevent the liquid from flowing past the ball 38 and upwardly through the tube 32.

The upper end of the tube 32 and the boss 26 preferably project upwardly from the closure transverse wall 24 a distance such that they are both sealed off when the container top 20 is threaded onto the closure top 10. Liquid cannot then pass into the closure top when the container is inverted.

In operation, with the closure top 10 substituted for the container top 20, inverting or tipping the liquid filled container 16 will cause its contents to flow out of the pouring passage 28. Simultaneously, air is admitted through the air passage 34 to the bottom of the container. Since the lower end of the tube 32 is so close to the bottom 18, the air will likely be admitted into the space or void immediately forming when the liquid is poured out. Thus, there is no opportunity for liquid to even enter the lower end of the tube. Further, since the tube 32 is radially offset oppositely of the pouring passage 28, it is even more likely that the lower end of the tube will be in an empty space. On the other hand, even if it is not, the presence of the ball check 36 prevents liquid from entering the tube 32. Also, as previously indicated, the ball check 36 will prevent liquid entry in the upright position of the container as well.

As a consequence, the ready admission of air, in most cases without any fluid head resistance, promotes a steady and regular flow of liquid from the pouring passage 28 in the inverted position of the container.

After using the container, the container top 20 is threaded onto the closure top 10 to isolate the container contents from atmosphere.

Various modifications and changes may be made with regard to the foregoing detailed description without departing from the spirit and scope of the invention.

What is claimed is:

1. A container closure for attachment to a container having an interior, a bottom, an externally threaded neck, a centerline, and an internally threaded container top for threading onto the neck to close the container, an improved closure comprising:

a closure top having an internally threaded lower portion for threadable attachment to the container neck upon removal of the container top, and an externally threaded upper portion for accepting the container top, said container top being mounted to said closure top in substantially vertical alignment with their respective outer peripheries a pouring passage for pouring liquid from the interior of the container, and an opening adjacent the pouring passage and offset from the centerline of the closure top; and an air passage including an elongated, unapertured tube having an upper extremity in communication with the opening in the closure top and defining an air passage from atmosphere to the interior of the container, the tube having a lower end located adjacent the bottom of the container in offset relation to the centerline, the lower end of the tube having a ball check valve having an open position and a closed position, and operative in the open position to allow air to pass out of the tube adjacent a lower portion of said liquid into a section of said container devoid of said liquid to provide a continuous substantially non-pulsating flow of said liquid through said pouring passage, and operative in the closed position to prevent liquid form flowing into the tube.

2. A container closure according to claim 1 wherein the closure top includes an upwardly projecting boss in communication with the pouring passage and defining a pouring spout.

3. A container closure according to claim 1 wherein the lower portion has an external diameter, and the upper portion has a diameter less than the external diameter of the lower portion.

4. In combination with a container having an interior, a generally circular bottom, an externally threaded neck, a centerline, and an internally threaded container top for threaded attachment to the neck, an improved container closure comprising:

a closure top having an internally threaded lower portion for threadable attachment to the container neck upon removal of the container top, said container top being mounted to said closure top in substantially vertical alignment with their respective outer peripheries, and an externally threaded upper portion for accepting the container top, a pouring passage for pouring liquid from the interior of the container, and an opening adjacent the pouring passage and offset from the centerline of the closure top; and an air passage including an elongated tube having an upper extremity in conjunction with the opening in the closure top and defining an air passage from atmosphere to the interior of the container, the tube having a lower end located adjacent the bottom of the container in offset relation to the centerline, the lower end of the tube having a ball check valve having an open position and a closed position, and operative in the open position to allow air to pass out of the tube into a section of said container devoid of said liquid to provide a substantially non-pulsating flow of said liquid through said pouring passage, and operative in the closed position to prevent liquid from flowing into the tube.

5. A container closure according to claim 4 wherein the closure top includes an upwardly projecting boss in communication with the pouring passage and defining a pouring spout.

6. A container closure according to claim 5 wherein the container top is threaded onto the closure top and seals the pouring spout from atmosphere.

7. A container closure according to claim 4 wherein the lower portion has an external diameter, and the upper portion has a diameter approximately the external diameter of the lower portion.

* * * * *